United States Patent [19]

Hopkins et al.

[11] Patent Number: 4,478,728

[45] Date of Patent: Oct. 23, 1984

[54] PROCESS AND COMPOSITIONS FOR PRESERVING FRESH HIDES AND SKINS

[75] Inventors: William J. Hopkins; Paula C. Sweeney, both of Philadelphia; David G. Bailey, Warminster, all of Pa.

[73] Assignee: The United States of America as represented by the Secretary of Agriculture, Washington, D.C.

[21] Appl. No.: 543,730

[22] Filed: Oct. 20, 1983

Related U.S. Application Data

[62] Division of Ser. No. 356,865, Mar. 15, 1982, Pat. No. 4,424,059.

[51] Int. Cl.[3] ..... C14C 9/00; C14C 1/04

[52] U.S. Cl. ..... 252/8.57; 8/94.18

[58] Field of Search ..... 8/94.18; 252/8.57

[56] References Cited

PUBLICATIONS

Hopkins et al., Jour. of the Amer. Leather Chemists Assoc., vol. LXVI, No. 11, (11/71); No. 2, (2/71).

*Primary Examiner*—Maria Parrish Tungol

*Attorney, Agent, or Firm*—M. Howard Silverstein; William E. Scott; David G. McConnell

[57] ABSTRACT

Methods of treating fresh animal hides and skins with compositions containing butyl carbitol and other compounds have been found to preserve the hides and skins.

2 Claims, No Drawings

PROCESS AND COMPOSITIONS FOR PRESERVING FRESH HIDES AND SKINS

This is a division of application Ser. No. 356,865, filed Mar. 10, 1982 now Pat. No. 4,429,059.

BACKGROUND OF THE INVENTION

1. Field of The Invention

This invention relates to the preservation of fresh cattlehides and hides and skins of other animals and more particularly to a method of preserving fresh hides and skins which conserves time, energy and water. The invention also relates to compositions for preserving fresh hides.

2. Description of The Art

At present cattlehides are preserved commercially by brining with saturated salt solutions containing biocides. After brining for about twelve hours, the hides are removed from the brine, drained, sprinkled with excess salt and bundles for shipment. Sometimes hides are wet-salted, that is, the hides are laid hair side down, excess salt is spread over the flesh surface, another hide laid on top of the previous one and the process repeated. Hides are also preserved by air drying which is sometimes supplemented with chemicals and/or antibacterial agents.

SUMMARY OF THE INVENTION

An object of this invention is to provide a method for preserving fresh animal hides and skins which conserves time, energy and water.

Another object is to provide a method of preserving fresh animal hides and skins which does not require that the hides be rehydrated before they are processed into leather.

Still another object is to provide a method of preserving fresh animal hides and skins which eliminates salt pollution in curing plant and tannery effluents.

A further object is to provide compositions useful for preserving fresh animal hides and skins.

According to this invention the above objects are accomplished by a method in which fresh animal hides and skins are treated with a fresh hide preserving effective amount of a hide preservative and a carrier.

DESCRIPTION OF THE INVENTION

Food animals throughout the world are transported to meat packers and processors for slaughter. The hides and skins are carefully removed to protect them from damage. Just as meat is perishable, so too are hides and skins. If not cleaned and treated to prevent putrifaction, they begin to decompose and lose leather-making substances within hours after removal from the carcass. The tanneries which process this raw material into leather may be some distance from the location of the meat packer. Therefore, it is essential that the hides and skins be well protected during transit to the tanneries. The required protective treatment administered to the hide or skin is called curing. It is not a tanning process but a treatment that provides an environment in which protein destroying organisms cannot function. As noted above, there are several known methods for curing hides and skins.

The processes and composition of this invention are quite different than the known methods and materials and provide a much faster cure while using less energy and water. In fact, a fresh cattlehide treated for one hour by the process of this invention and then stored for six days in a plastic bag was in excellent condition. Microbial and enzymic activity had been thoroughly controlled and the hide was later processed into commercially acceptable leather. The treatment and compositions of this invention are used at ambient room temperatures, that is, about 20°–25° C. The hide or skin is agitated with the selected composition in a drum for one hour at about six r.p.m. and then allowed to drain. The hide or skin can then be put into a plastic bag and sealed for shipment.

Cattlehides have been successfully preserved by the process of this invention using butyl carbitol (diethylene glycol monobutyl ether), butyl carbitol acetate (diethylene glycol monobutyl ether acetate), diethyl carbitol (diethylene glycol diethyl ether), butoxy triglycol, and butoxy ethoxy propanol as preservatives and water as a carrier. Other chemicals closely related structurally to the above preservatives failed to preserve hides when used in the same way and at the same concentrations. These chemicals are ethylene glycol, diethylene glycol, ethyl carbitol (diethylene glycol monoethyl ether), ethoxy triglycol, methoxy triglycol, methyl carbitol (diethylene glycol monomethyl ether), and carbowax 600 (polyethylene glycols and methoxypolyethylene glycols).

In one embodiment of the invention a fresh hide or skin was agitated for one hour in an aqueous solution containing 20% of the preservative with sufficient water added to make a 100% float, all amounts based on the weight of the hide. The hide or skin was drained, sealed in a container and stored at about 30° C. At the end of eight days the hide was examined. When the preservative was any of the following, the hides were successfully preserved: butyl carbitol, carbitol acetate, diethyl carbitol, butoxy triglycol, or butoxy ethoxy propanol. When the preservative was any of the following, the hides were not successfully preserved: ethylene glycol, diethylene glycol, ethyl carbitol, ethoxy triglycol, methoxy triglycol, methyl carbitol, or carbowax 600.

A cattlehide treated for one hour with an equal weight of a 20% solution of butyl carbitol in water was successfully preserved and in excellent condition after 28 days storage in a sealed container.

We also found that the amount of preservative needed in the compositions used for treating hides and skins can be reduced significantly by using low concentrations of certain acids and a low float. Fresh samples of cattlehide were treated with an aqueous composition containing 2.0% butyl carbitol, 1.0% formic acid, and 0.03% of a nonionic detergent/emulsifier, tergitol 15-S-9 (polyethylene glycol ether of a secondary alcohol), with enough water added to make a 20% float, all amounts based on the weight of the hide sample. The sample and treating composition were agitated for 15 minutes and then stored at about 30° C. When the samples were examined after 7 days and again after 12 days there was no visible growth or off odor. The microbial count was low and there was no evidence that proteolytic enzymes had been active. Similar results were obtained when 2.0% $NaHSO_4$ or 1.0% acetic acid or 1.0% proprionic acid was substituted for the 1.0% formic acid. Controls using 2.0% butyl carbitol alone or each of the acids at the above concentrations alone exhibited visible growth or bad odor or both after 4 days storage at 30° C.

A cattlehide sample was successfully preserved for at least eight days by painting the flesh side of the sample with undiluted (100%) butyl carbitol until the weight of the sample increased by 4.0%.

The invention is further exemplified by the following examples in which a cattlehide or samples of cattlehide from freshly slaughtered animals are treated by the method of this invention. All percentages are based on the weight of the hide or hide sample. Test results of Examples 1–8 are shown in the Table 1 and those of Example 9 in Table 2.

EXAMPLE 1

A hide sample was treated with a composition containing 20% butyl carbitol, and 80% water by agitating for about one hour at approximately 200 vibrations per minute on a reciprocal shaker. After treatment the sample was drained for 15 minutes and then stored in an ordinary jar at 30° C. The sample was examined at the end of four days and again at the end of eight days.

EXAMPLE 2

A hide sample was treated as in Example 1 except that the sample was drained for 20 hours in a covered environment to prevent loss of moisture by evaporation. The stored sample was examined as in Example 1.

EXAMPLE 3

A hide sample was treated as in Example 1 except that the treating composition contained 10% butyl carbitol and 40% water. The stored sample was examined as in Example 1.

EXAMPLE 4

A hide sample was treated as in Example 3 except that the sample was drained for 20 hours as in Example 2. The stored sample was examined as in Example 1.

EXAMPLES 5 and 6

Individual hide samples were treated as in Examples 1 and 2, respectively. However, a test for proteolytic enzyme activity, that is, a one hour gelatin film test, was made instead of the lime test. The stored samples were examined at the end of three days and again at the end of eight days.

EXAMPLE 7

The following samples were run as controls:

(a) Untreated hide sample stored in jar at about 30° C. for 3 days (b) Hide sample treated as in Example 1 without the butyl carbitol and stored at about 30° C. for 3 days (c) Hide sample treated as in Example 2 without the butyl carbitol and stored at about 30° C. for 40 days.

EXAMPLE 8

A hide was treated by drumming for one hour in a composition containing 20% butyl carbitol and 80% water. The hide was then drained for 1.5 hours and stored in a sealed plastic bag at ambient room temperature of about 20°–25° C. for six days.

EXAMPLE 9

A hide treated as in Example 8 was processed into commercially acceptable leather. The tensile strength, Satra grain crack characteristics shrink temperature (Ts) of the leather was compared with those characteristics of a leather prepared from a hide that was salt cured.

TABLE 1

| Example | Storage Time (days) | Bact./g. hide × $10^6$ | |
|---|---|---|---|
| | | | Lime Test |
| 1 | 4 | 214 | +[1] |
| | 8 | 244 | + |
| 2 | 4 | 178 | + |
| | 8 | 86 | + |
| 3 | 4 | 174 | + |
| | 8 | 546 | + |
| 4 | 4 | 114 | + |
| | 8 | 590 | + |
| | | | 1 hr. gelatin film test |
| 5 | 3 | 112 | +[2] |
| | 8 | 126 | + |
| 6 | 3 | 209 | + |
| | 8 | 99 | + |
| 7 (a) | 3 | 1,700 | – |
| (b) | 3 | 571 | – |
| (c) | 4 | 783 | – |
| 8 left | 6 | 1.5 | + |
| right | 6 | .46 | + |

[1] + means that the hide was in satisfactory condition after storage for the indicated number of days

[2] + means absence of observable evidence of proteolytic activity

– means presence of observable evidence of proteolytic activity

TABLE 2

| Hide Treatment | Side | Thickness (in.) | Elongation (%) | Tensile (p.s.i.) |
|---|---|---|---|---|
| | | Tensile Strength (parallel) | | |
| This invention | L | .042 | 35.8 | 2609 |
| | R | .041 | 37.5 | 2514 |
| Standard salt | L | .042 | 47.0 | 2130 |
| | R | .039 | 52.0 | 2300 |
| | | Satra Grain Crack | | |
| | Side | Thickness (cm) | Extension (mm) | |
| This invention | L | .112 | 8.58 | |
| | R | .107 | 8.52 | |
| Standard salt | L | .102 | 8.74 | |
| | R | .096 | 8.16 | |
| | | Ts(°C.) | | |
| This invention | | 104 | | |
| Standard salt | | 103 | | |

We claim:

1. A composition for preserving fresh animal hides comprising a fresh hide preservative effective amount of butyl carbitol as a concentration of 2.0% based on the weight of the hide, water, an acid selected from the group consisting of formic acid, sodium bisulfate, acetic acid, and proprionic acid, and the surface active agent tergitol 15-S-9.

2. The composition of claim 1 wherein the concentration of the surface active agent is 0.03% and the concentration of acid is from 1.0 to 2.0%, all concentrations based on the weight of the hide.

* * * * *